United States Patent [19]

Adinolfi et al.

[11] Patent Number: 4,563,239

[45] Date of Patent: Jan. 7, 1986

[54] CHEMICAL MILLING USING AN INERT PARTICULATE AND MOVING VESSEL

[75] Inventors: Robert G. Adinolfi, Manchester; Melvin C. Barlow, East Hampton; Raymond M. Hammond, Enfield, all of Conn.

[73] Assignee: United Technologies Corporation, Hartford, Conn.

[21] Appl. No.: 661,494

[22] Filed: Oct. 16, 1984

[51] Int. Cl.[4] ..... C23F 1/00; B44C 1/22; C03C 15/00; C03C 25/06

[52] U.S. Cl. ..... 156/639; 156/664; 156/345; 252/79.3

[58] Field of Search ..... 156/637, 639, 642, 645, 156/656, 659.1, 664, 345; 252/79.2, 79.3

[56] References Cited

U.S. PATENT DOCUMENTS 2,981,610 4/1961 Snyder et al. ..... 41/42

3,745,079 7/1973 Cowles et al. ..... 156/18

3,788,914 1/1974 Gumbelevicius ..... 156/639 X 3,891,456 6/1975 Hohman et al. ..... 156/645 X

OTHER PUBLICATIONS

"Cleaning and Finishing of Titanium Alloys", Metals Handbook, vol. 2, pp. 665–666, Eighth Edition.

"Machining of Titanium Alloys", Metals Handbood, Eighth Edition, vol. 3, pp. 505–506.

*Primary Examiner*—William A. Powell

*Attorney, Agent, or Firm*—C. G. Nessler

[57] ABSTRACT

Thin edged workpieces are chemically milled to remove material uniformly from their surfaces by tumbling the workpieces in a barrel in which is contained a sufficient volume of inert polymer particulate media. Titanium airfoils for turbomachinery are able to have an oxidized surface layer removed without suffering small nicks and other damage to their critically shaped edges.

8 Claims, 2 Drawing Figures

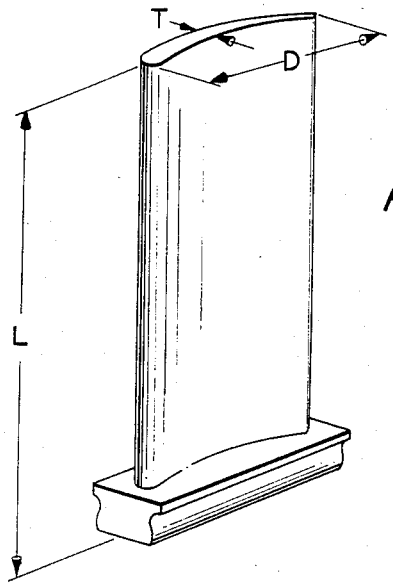
FIG. 1
FIG. 2
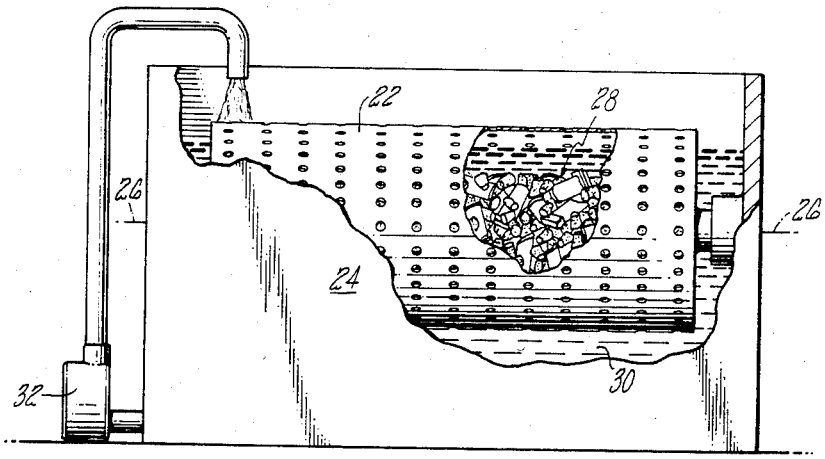

CHEMICAL MILLING USING AN INERT PARTICULATE AND MOVING VESSEL

TECHNICAL FIELD

The present invention relates to metalworking, in particular to the mass finishing of titanium metal parts by chemical milling.

BACKGROUND

As is well known, the efficiency of the compressor section of a gas turbine is especially important in aircraft applications. Very close dimensional precision must be obtained in the parts, to optimize the aerodynamic performance of such machines. There have been many years of experience in making compressor parts and in working titanium alloys, of which they are often made. Thus the procedures for making compressor parts have been highly refined. However, a relentless demand by users for improved efficiency has continuously raised the degree of precision which must be obtained in compressor parts, and in particular the airfoil sections of such parts. Variations, defects and discrepancies which previously might be overlooked now must be eliminated.

To manufacture airfoils, metal is often first precision forged to nearly the final dimension and then the parts are finish machined. But during forging a thin oxidized layer, or an "alpha case" (alpha phase surface layer), is typically formed due to high temperature exposure. Chemical milling is then desirably used to generally remove this contaminated material. The basic process of chemical milling of titanium alloys is described in U.S. Pat. No. 2,981,609 to Snyder et al and in U.S. Pat. No. 3,745,079 to Cowles et al. See also "Chemical Machining (of Titanium Alloys)" in the Metals Handbook (American Society for Metals) Eighth Edition, Volume 3, pages 505–506.

An expeditious way of chemical milling is barrel finishing. Barrel finishing is employed in many industrial processes, e.g., plating, and essentially consists of placing a quantity of parts in a drum which rotates. But, one of the problems of such a procedure is that the parts tend to impact one another. Thus, when it was sought to apply barrel finishing to the chemical milling of titanium airfoils, small nicks of up to 0.25 mm deep were produced in the relatively fragile leading and trailing edges. Such a result is contradictory to an essential object of producing smooth edges, since in compressor airfoils the contour of the leading and trailing edges is quite important. As a result, the way titanium airfoils have been finished hereto when chemical milling has been used, has been to individually hold the parts in fixtures within the corroding medium. While this procedure has been technically satisfactory, in an effort to improve results and reduce costs, the work which led to the present invention was undertaken.

After chemical milling away the alpha case, mass abrasive finishing is usually used to smooth the leading and trailing edges. Of course, metal parts have been abrasively finished in barrels, usually vibrating vertical-axis barrels, for many years. In such a procedure, parts are immersed within a relatively large quantity of abrasive media, usually ceramic pellets. When motion is imparted to the barrel the pellets move against the surface of the metal objects and gently and uniformly machine them. But, such a procedure is not particularly useful in the desired general removal of alpha case from thin titanium airfoils of gas turbine engine compressors. The amount of finishing needed to remove a typical 0.05–0.12 mm of alpha case requires an undue time. And under such conditions there will be preferential material removal from the leading and trailing edges; while they are rounded there is excessive material removal and the overall chord length of the part will be unacceptably altered.

DISCLOSURE OF THE INVENTION

An object of the invention is to remove material uniformly from the surfaces of thin and fragile workpieces. A particular object of the invention is to chemically mill titanium compressor blades without damaging their leading and trailing edges.

According to the invention airfoils and other thin edged workpieces can be effectively finished by placing the workpieces in a rotating barrel or other vessel in which is contained both a chemical etchant solution adapted to attack the workpiece material and a large quantity of inert media particulate which is denser than the chemical etchant solution and less dense than the workpiece material. The barrel is rotated within a tank while the chemical solution is circulated through it by means of pumps. Combined tumbling and circulating actions result in uniform removal of material from the parts. Yet, because of the invention the parts are prevented from coming into contact with one another with any significant force. As a result, when the parts are separated from the media and solution after sufficient time has elapsed it is found a uniform layer has been removed and there is an absence of nicks and other damage.

In the preferred embodiment of the invention titanium alloy airfoils are placed in an aqueous solution of nitric acid and hydrofluoric acid; the media is a polyester polymer of a specific gravity of about 1.25 or greater. The horizontally disposed barrel moves at a relatively low speed of about 3 rpm. The volume ratio between the plastic media and the metal parts is of the order of 2:1 or greater. The foregoing and other objects, features and advantages of the present invention will become more apparent from the following description of preferred embodiments and accompanying drawings.

BRIEF DESCRIPTION OF THE DRAWINGS

FIG. 1 shows a typical compressor airfoil.

FIG. 2 shows in cross section how airfoils are chemically milled in a horizontal rotating barrel.

BEST MODE FOR CARRYING OUT THE INVENTION

The present invention is described in terms of the finishing of an airfoil 20 made of the titanium alloy Ti-6Al-4V, such as that shown in FIG. 1. However, it will be appreciated that the principles of the invention are applicable to the finishing of other thin or fragile articles made of other materials. As illustrated by FIG. 2, the milling is preferably done by placing the parts in a cylindrical drum or barrel 22 which is mounted in a tank 24 with its long axis 26 horizontal. The 0.46 m dia barrel is perforated, mostly immersed in the etchant 30, and a motor (not shown) rotates it about its axis 26 at about three revolutions per minute to impart a gentle tumbling action to the mass 28 of media and parts.

Chemical milling is caused by the action of the nitric acid and hydrofluoric acid. The solution, or etchant, is by volume percent 8–16 concentrated nitric acid, 3–10 concentrated hydrofluoric acid, with a commercial wetting agent added as needed. It has a specific gravity of about 1.1. Preferably, the etchant is comprised of 14 volume percent $HNO_3$ and 9 volume percent HF, with 0.4 ml/l of wetting agent, such as Orvus WA (Procter & Gamble Co., Cincinnati, Ohio USA). Milling takes place at 20–30 C. Included in the barrel which contains the etchant must be a relatively large quantity of inert polymer material particulate which has a specific gravity, typically at least 1.25, which is greater than that of the solution. Virtually all aqueous corrodents will have a specific gravity greater than 1.0. Preferably, the media is a conical shaped non-abrasive pellet, nominally 14 mm in dimension, made of an unsaturated cross-lined polyester. Another usable material is the CLEPO 6000 Series 9/16 Diameter Cone, available from Frederick Gumm Chemical Company, Smithfield, R.I. USA. A preferred media is the product "B.C.S. P.Q. 9/16 Special N.A." available from B.C.S. Company, Inc., Thompson, Conn., USA. This contains polyester resin, catalysts and styrene monomer; notable is the lack of inorganic or abrasive filler.

A typical compressor airfoil, as shown in FIG. 1, has dimensions of about 30 mm chord length D by about 100 mm airfoil length L and about 5 mm typical centerline thickness T. The airfoils are interspersed with the media in the barrel at the time of loading. As an example, as many as 400 parts may be placed in a barrel of about 0.46 m dia by 0.92 m length. The barrel is about 90 percent immersed in the solution and is then caused to rotate slowly while the etchant is circulated through the tank holding the barrel by means of a pump 32 shown in FIG. 2. Periodic removal of a sample of several parts from the barrel is used to monitor, by measuring weight loss, the extent to which the chemical milling is taking place. In the process at least 0.1 mm, and typically 0.13 mm, of material will be uniformly removed from the surface.

The presence of the media aids uniform chemical milling of parts and prevents damage to their edges, provided the media presence meets certain requirements. As noted, the media must be heavier than the etchant solution, so the media is not buoyed up by the solution; and, the media should have a specific gravity less than the workpiece material. Titanium parts have a specific gravity of about 4.5 and they are heavier than both the exemplary media and solution. Provided the foregoing conditions are met and the proportions of media and parts is correct, the parts will not settle out or significantly come in contact with one another to a degree which causes any damage. Typically, the volume proportion of media to blades is about 1:2 or greater, preferably 1:3. With lesser proportion than 1:2 there will tend to be damaging contact between the parts. Any proportion greater than 1:3 may be used but excess amount of media leads to inefficiency in the productivity of the equipment. Further the barrel must be at least one quarter and preferably no more than three quarter full. If more than three quarter full sufficient tumbling action and relative motion between the parts and media may not be achieved; non-uniform etching will result. If less than one quarter full, and with the minimum proportion of media, there will be a tendency for undue damaging contact between the parts. The following is our deduction of the reason that observing the foregoing criticalities produces favorable results. (It should be noted that the relatively superficial nicking which is unacceptable in turbomachinery airfoil applications probably is considered trivial and entirely acceptable in many other fields. We believe this is the likely reason our invention has not been revealed heretofore.)

In the absence of any polymer media, even though the action of the barrel may be gentle and the parts generally tend to slide over one another, there is nicking of the edges. We believe that the nicking probably occurs when a part lies against the barrel wall and is lifted above the others, to then be dropped onto the general sliding mass of parts. When there is media present but the media is less dense than the solution, the workpieces remain tumbling among themselves at the lowermost portion of the barrel while the particulate floats above and there is no benefit. If the media is denser than the workpieces, then the media tends to remain beneath the workpieces in the barrel and the aforementioned nicking will occur as the workpieces rise to the top and tumble onto each other, as they do in the absence of media. When the requirements of our invention are met and the media has the proper density then there is sufficient media near the top of the mass of parts and media in the barrel. Any tumbling of parts at the top will be only onto a bed of media sufficient to cushion and avoid damaging contact between the parts. Of course, our preferred practice of having the barrel three qurters full also aids this achievement in that the extent of any tumbling is minimized. Even though one might imagine some gravitational tendency for stratification between the media and workpiece due to their differing densities, evidently the small and regular shape of the media enables it to be sufficiently interspersed and dispersed by the comparatively large and irregularly shaped blades, provided there is sufficient volume proportion of media present.

When it has been determined that sufficient material has been etched from the parts, the combined media and parts mass is passed over a screen sized to pass the media through the openings but to retain and separate out the blades.

While we prefer the polymer material which we describe above, other materials may be substituted, so long as they are denser than the etching solution and not significantly attacked by the chemical solution. It is within our contemplation that certain durable and chemical resistant ceramics and metals may be used in place of plastic media which we prefer. And while we prefer the cone shape we describe, other sizes and shapes of media may be used. Of course, the temperature and bath composition must be controlled carefully to obtain predictable and consistent results. As is well known, care should be taken to ensure that the conditions used for chemical milling do not cause substantial hydrogen absorption and resultant embrittlement of the titanium alloys. Any solution may be used which is suitable for attacking the workpiece when it is some other material. Lastly, while we describe a horizontal axis plating barrel, other apparatus which imparts gentle tumbling or turning motion to the media and workpieces may be used.

Although this invention has been shown and described with respect to a preferred embodiment, it will be understood by those skilled in the art that various changes in form and detail thereof may be made without departing from the spirit and scope of the claimed invention.

We claim:

1. The method of chemical milling thin edged workpieces which comprises placing the workpieces in a vessel where there is present an etchant having a specific gravity less than that of the workpieces, characterized by mixing with the workpieces a particulate media which is inert to the etchant and has a specific gravity intermediate the specific gravity of the etchant and the specific gravity of the workpieces; imparting motion to the vessel or contained mass of workpieces, media and etchant, to cause relative motion among the several constituents; wherein the proportions of the particulate media and metal workpieces are sufficient to keep the workpieces from hitting each other with any force and thereby causing damage to the workpiece edges.

2. The method of claim 1 wherein the workpieces are of titanium base, the etchant is an aqueous acid solution, and the media is a polymer having a specific gravity of 1.25 or greater.

3. The method of claim 1 characterized by containing the workpiece in a horizontal axis cylindrical barrel vessel and by rotating the vessel to cause relative motion.

4. The method of claim 1 characterized by the volume ratio of media to parts being 2:1 or greater.

5. The method of claim 4 characterized by the workpieces being titanium alloy and the media being a polymer.

6. The method of claim 2 characterized by the volume ratio of media to parts being 2:1 or greater.

7. The method of claim 5 characterized by the etchant containing nitric acid and hydrofluoric acid.

8. The method of claim 5 characterized by the etchant being an aqueous solution by volume 8–16 concentrated nitric acid and 3–10 concentrated hydrofluoric acid.

* * * * *